United States Patent [19]

Kobayashi et al.

[11] Patent Number: 4,467,158

[45] Date of Patent: Aug. 21, 1984

[54] PUFFER TYPE GAS CIRCUIT

[75] Inventors: Akio Kobayashi; Yasuo Ozaki; Sunao Rikitake, all of Yokohama, Japan

[73] Assignee: Tokyo Shibaura Denki Kabushiki Kaisha, Kawasaki, Japan

[21] Appl. No.: 553,429

[22] Filed: Nov. 21, 1983

[30] Foreign Application Priority Data

Oct. 26, 1978 [JP] Japan ..... 53-147358
Oct. 26, 1978 [JP] Japan ..... 53-147359

Related U.S. Application Data

[63] Continuation-in-part of Ser. No. 349,158, Feb. 16, 1982, abandoned, which is a continuation of Ser. No. 86,331, Oct. 19, 1979, abandoned.

[51] Int. Cl.[3] ..... H01H 33/88

[52] U.S. Cl. ..... 200/148 A; 200/148 R

[58] Field of Search ..... 200/148 A, 150 G, 148 R

[56] References Cited

U.S. PATENT DOCUMENTS 2,459,599 1/1949 Strom ..... 200/150 G
3,839,613 10/1974 Tsubaki et al. ..... 200/148 A
3,909,572 9/1975 Tsubaki et al. ..... 200/148 A
4,229,627 10/1980 Rostron ..... 200/148 A

*Primary Examiner*—Robert S. Macon

*Attorney, Agent, or Firm*—Oblon, Fisher, Spivak, McClelland & Maier

[57] ABSTRACT

A puffer type gas circuit breaker comprises a stationary piston, a movable puffer cylinder into which the stationary piston is inserted, a ring-shaped movable arcing contact provided at the forward end of the movable puffer cylinder, a rod-shaped stationary arcing contact disposed concentrically with the ring-shaped movable arcing contact, and a nozzle which blows compressed arc-extinguishing gas filled in the movable puffer cylinder on to arcs produced between both arcing contacts when the operation of the circuit breaker is actuated thereby puffing out said arcs, wherein an arc-resisting section prepared from arc-resisting metal is mounted on those portions of both arcing contacts which are exposed to arcs, the arcs touches the arc-resisting portions alone, thereby preventing both arcing contacts from being damaged by arcs. No arcs arises between both arcing contacts before the shutoff of current; restriking does not appear between the arcing contacts after the shutoff of current; and current can be shut off under a stable condition.

2 Claims, 9 Drawing Figures

PUFFER TYPE GAS CIRCUIT

This application is a continuation-in-part of application Ser. No. 349,158, filed Feb. 16, 1982, abandoned, which is a continuation of Ser. No. 086,331, filed Oct. 19, 1979, abandoned.

BACKGROUND OF THE INVENTION

This invention relates to improvements on a puffer type gas circuit breaker using a puffer piston cylinder assembly.

To date, a puffer type gas circuit breaker has been applied to shut off a large current in a short time and reliably. With the prior art circuit breaker of the above-mentioned type, a movable arcing contact 1 which is formed of a plurality of arcing contact fingers 2 arranged in a ring form and surrounded by a nozzle 3 prepared from electrically insulating material is fixed to the outer end of a movable puffer cylinder 4, into which a stationary puffer piston 5 is inserted. A stationary arcing contact 6 is provided to concentrically face the movable arcing contact 1. Arc-resisting portions 7, 8 prepared from arc-resisting metal are respectively formed on the inner walls of the forward end portions of the arcing contact fingers 2 and that end portion of the stationary arcing contact 6 which faces the inner walls of the contact fingers 2. Where the conventional puffer type gas circuit breaker is shifted from a closed state indicated in 2 dots-dash lines to an open state indicated in solid lines, these portions of the arcing contact fingers 2 and stationary arcing contact 6 which the arc-resisting portions 7, 8 are disposed are prevented from being damaged by heat when exposed to arcs of large current produced between both arcing contacts 1, 6 when they are opened.

In recent years, the rated current capacity of a puffer type gas circuit breaker progressively increases as 40,000 to 50,000 A, 50,000 to 63,000 A, 63,000 to 80,000 A. As a result, an arc in the passage of an arc-extinguishing gas extremely increases in diameter and energy, resulting in the loss of the current-shutting-off property of the above-mentioned circuit breaker and the effective life of the various contacts. The customary practice to cope with such difficulties is to increase the force of pulling the puffer cylinder of the circuit breaker and/or increase the diameter of the puffer cylinder so as to compress the arc-extinguishing gas filled in the puffer cylinder to increase the pressure of the compressed gas for shutting off current more efficiently. However, this conventional process has the drawbacks that arcs 9 produced between the movable arcing contact 1 and the stationary arcing contact unavoidably expand, as shown in dotted lines in FIG. 1, beyond the arc-resisting portion 7 of the stationary contact 6 and extend beyond the stationary arc-resisting portion 8 to reach the portion of the stationary arcing contact 6 which is adjacent to the portion 8 and which is not protected by arc-resisting metal. Where, therefore, circuit breakage was repeated often by short circuit currents, the forward end faces of the arcing contact fingers 2 were damaged by the arcs as marked with the numeral 10 in a circle A of enlarged representation. As a result, the sharp edge 11 of the arc-resisting portion 7 protruded from the end face of the respective arcing contact fingers 2. Since the gradient of the potential in the proximity of the sharp edge 11 of the arcing contact fingers 2 became large, restriking of arcs sometimes appeared between the stationary arcing contact 6 and the sharp edge 11 of the arcing contact fingers 2 due to restriking voltage being produced immediately after the shutoff of current. Therefore, the known puffer type gas circuit breaker had the drawback that the current shutting-off characteristics were extremely lost.

Further disadvantages of the customary puffer type gas circuit breaker were that since the arc-resisting portion 8 was only formed on the furthest end of the stationary arcing contact 6, that section of the stationary arcing contact 6 which was adjacent to the arc-resisting portion 8 was damaged by the arcs and decreased in diameter as marked with the numeral 12 in a circle B. Where, therefore, the prior art circuit breaker was closed, the contacting pressure with which the movable arcing contact 1 and stationary arcing contact 6 were pressed against each other was reduced, resulting in unsatisfactory current passage. As a result, arc was produced between the movable arcing contact 1 and stationary arcing contact 6 and the section 12 of the stationary arcing contact 6 is damaged by the arcs with a decline in diameter, before these contacts 1, 6 reached the opening points, prominently shortening their effective life.

SUMMARY OF THE INVENTION

The object of this invention is to provide a puffer type gas circuit breaker, in which those parts of the stationary arcing contact and movable arcing contact which are exposed to arcs produced between the contacts are formed of arc-resisting portions prepared from arc-resistant material, thereby ensuring the more reliable shutoff of large electric current and prolonging the effective life of both stationary and movable arcing contacts.

Moreover, if, in case main contacts are used, the section 12 of the stationary arcing contact 6 is damaged by arcs with a decrease in diameter, arcs are generated between the main contacts when they are opened. Since, in this case, the arc-extinguishing gas is not blown on to the arcs thus produced, the customary puffer type gas circuit breaker has the drawback that the current-shutting efficiency is prominently lost.

According to this invention there is provided a puffer type gas circuit breaker which comprises a housing filled with arc-extinguishing gas, a rod-shaped stationary arcing contact immovably set in the housing and connected to a first conductor, a stationary puffer piston immovably set in the housing in alignment with the stationary arcing contact and connected to a second conductor, a movable puffer cylinder into which the stationary piston is inserted and which is reciprocated along the piston, drive means for effecting the reciprocation of the movable puffer cylinder, a movable arcing contact which is disposed concentrically with the stationary arcing contact at that end of the movable puffer cylinder which faces the stationary arcing contact, and, when both contacts are closed by the movable puffer cylinder, slidingly contacts the stationary arcing contact, and when both contacts are opened, allows for their separation, guide means for blowing compressed arc-extinguishing gas filled in the movable puffer cylinder on to arcs generated between the stationary and movable arcing contacts when they are closed, thereby puffing out the arcs, and first and second arc-resisting portions which are prepared from arc-resisting metal and provided an all those portions of the movable arcing contact and stationary arcing contact which are exposed to arcs produced between both arcing contacts.

BRIEF DESCRIPTION OF THE DRAWINGS

This invention can be fully understood from the following detailed description with reference to the accompanying drawings in which.

DESCRIPTION OF THE PREFERRED EMBODIMENTS

Figure 2:
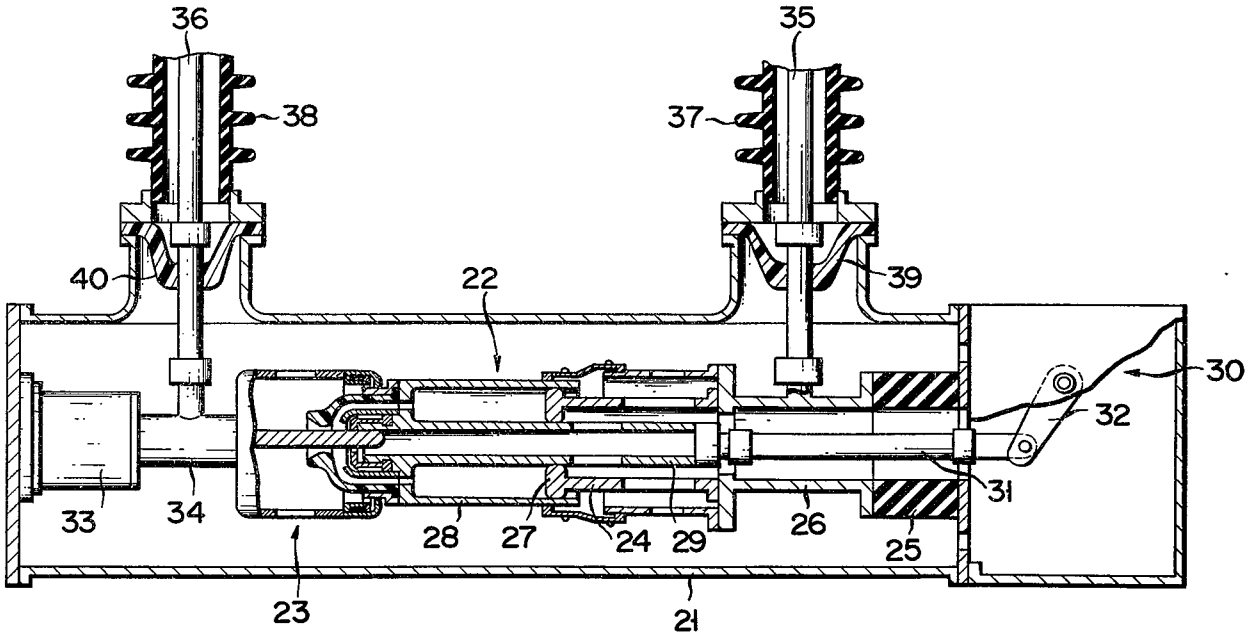
FIG. 2 is a longitudinal sectional view of the whole of a puffer type gas circuit breaker embodying this invention.

Referring to FIG. 2, a puffer-type gas circuit breaker embodying this invention has a housing 21 filled with arc-extinguishing gas such as sulfer hexafluoride ($SF_6$). The housing 21 contains a puffer piston-cylinder assembly 22 aligned with a statonary contact head 23.

The piston-cylinder assembly 22 comprises a hollow cylindrical support member 25 made of electrically insulating material; a hollow cylindrical piston rod 24, one end of which is carried by a hollow cylindrical electrically conducting member 26; a ring-shaped stationary puffer piston 27 formed at the other end of the piston rod 24; and a movable puffer cylinder 28 into which the stationary piston 27 is inserted. The movable puffer cylinder 28 contains a hollow cylindrical shaft 29 whose peripheral surface slides along the inner wall of the ring-shaped stationary puffer piston 27, and which extends through the hollow cylindrical electrically conducting member 26, and is further connected by means of a connection rod 31 made of electrically insulating material to a drive mechanism 30 including a link 32 used for reciprocation of the movable puffer cylinder 28.

That end of the stationary contact head 23 which is remote from the piston-cylinder assembly 22 is carried by a support member 33 made of electrically insulating material and electrically conducting member 34. One end of a conductor 35 is fixed to the conducting member 26, and that of a conductor 36 is fixed to the conducting member 34. The conductors 35, 36 respectively pass through bushings 37, 38 provided at both ends of the housing 21 and are supported by spacers 39, 40 made of electrically insulating material.

Figure 1:
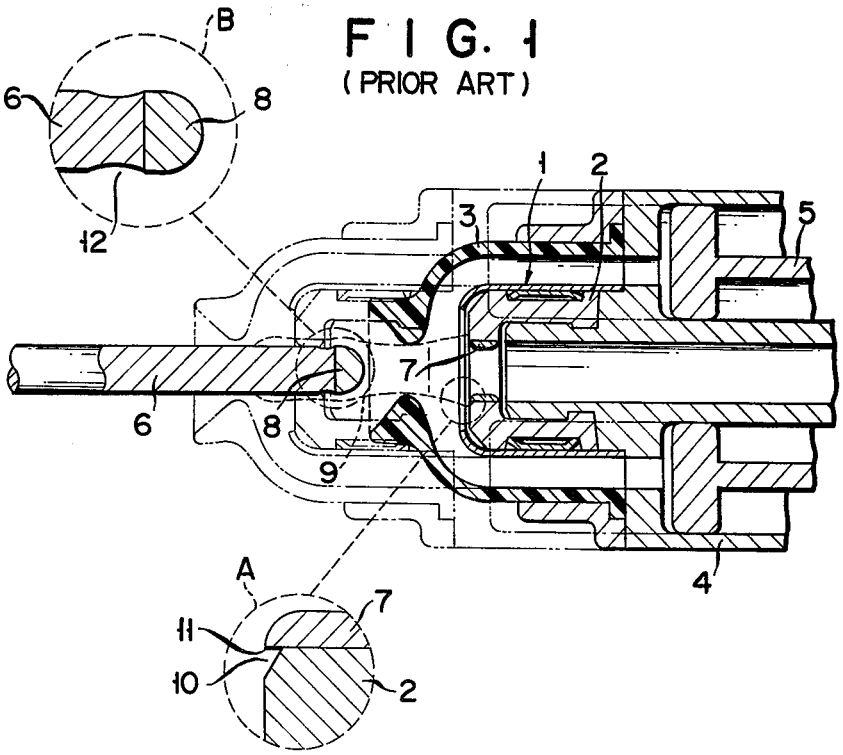
FIG. 1 (PRIOR ART)
FIG. 1 is a longitudinal sectional view of the main part of the prior art puffer type gas circuit breaker.
Figure 3:
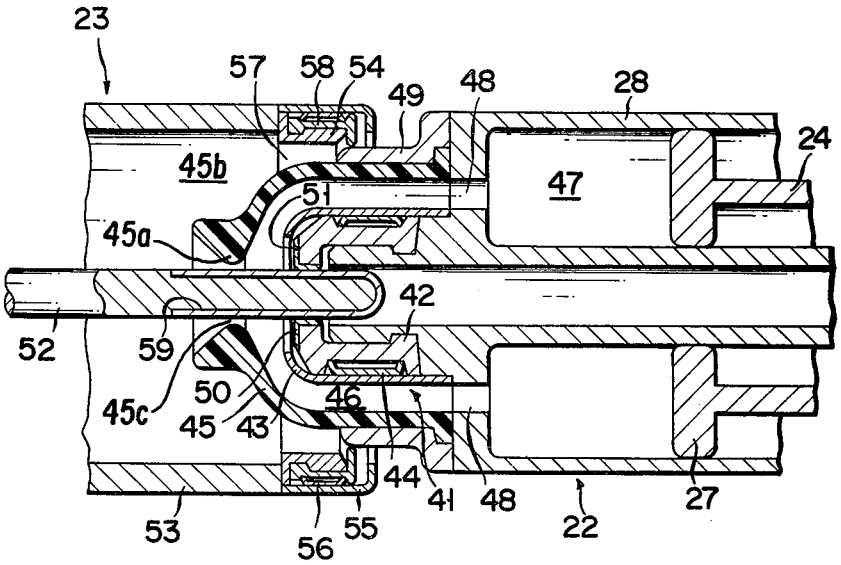
FIG. 3 is a longitudinal sectional view of the main part of a puffer type gas circuit breaker according to one embodiment of this invention when the main part is closed.
Figure 4:
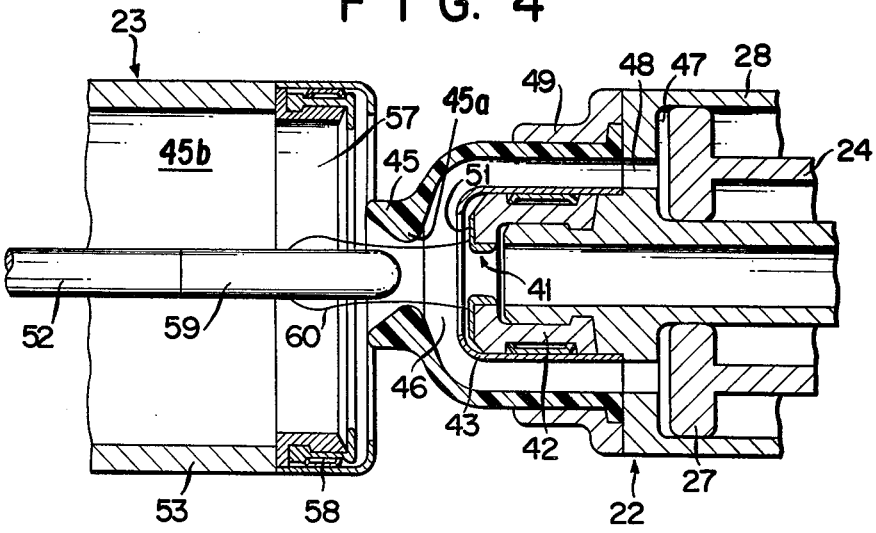
FIG. 4 is a longitudinal sectional view of the main part of the circuit breaker according to said embodiment when the main part is opened.

Referring to FIGS. 3 and 4, a movable arcing contact 41 is provided at the forward end of the movable puffer cylinder 28. This arcing contact 41 comprises a plurality of substantially H-shaped plate contact fingers 42 (FIG. 5) arranged in an annular or ring form. The arcing contact 41 is enclosed in a hollow cylindrical cover 43. The respective contact fingers 42 are normally elastically urged toward the axis of the movable puffer cylinder 28 by the corresponding plate springs 44 set between the contact fingers 42 and hollow cylindrical cover 43.

A cup-shaped nozzle 45 which is prepared from electrically insulating material such as polytetrafluoroethylene, and whose central portion is provided with a throat 45*a* is fixed to, and disposed concentrically with the movable puffer cylinder 28 in a state enclosing the cover 43. The movable puffer cylinder 28 and cover 43 define a passage or guide means 46 for conducting compressed arc-extinguishing gas filled in the cylinder chamber 47 through holes 48 formed in the forward end wall of the cylinder 28 and a below-mentioned ring-shaped gap 45*c* to the space outside of the cup-shaped nozzle 45.

Figure 5:
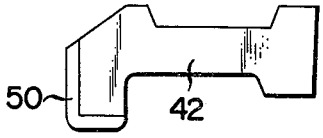
FIG. 5 is a side view of an arcing contact finger used with the puffer type gas circuit breaker of FIGS. 3 and 4 embodying this invention.

A ring-shaped main movable contact 49 surrounding the nozzle 45 is fixed to the forward end of the movable puffer cylinder 28. An L-shaped contact element 50 prepared from arc-resisting material such as copper-tungsten alloy is fixed, as shown in FIG. 5, to the front end wall of each contact finger 42 and the inner wall thereof which is contiguous to the front end wall. These L-shaped contact elements 50 jointly constitute an arc-resisting portion 51.

The statonary contact head 23 comprises a rod-shaped stationary arcing contact 52 extending from the conducting member 34 (FIG. 2) concentrically to the movable puffer cylinder 28; a hollow cylindrical electrically conducting member 53 surrounding the stationary arcing contact 52; a ring-shaped contact finger-supporing member 54; a ring-shaped cover 55 surrounding the contact finger-supporting member 54; and a main stationary contact 57 which is disposed between the contact finger-supporting member 54 and ring-shaped cover 55 and constituted by a plurality of contact fingers 58 elastically urged by the corresponding plate springs 56 toward the axis of the contact finger-supporting member 54 and arranged in a ring form. Since the diameter of the throat 45*a* of the cup-shaped nozzle 45 is greater than that of the rod-shaped stationary arcing contact 52, the ring-shaped gap 45*c* is made between the cup-shaped nozzle 45 and the stationary arcing contact 52. The difference in size between the two diameters is not so small that the spouting of the arc-extinguishing gas from the ring-shaped gap 45*c* remains unclogged even when arcs are being generated in a circuit cutoff operation of the breaker.

Where the puffer type gas circuit breaker of this invention is closed as shown in FIG. 3, the main stationary contact 57 or annularly arranged contact fingers 58 are pressed against the main movable contact 49, and the stationary arcing contact 52 contacts the movable arcing contact 41 or contact fingers 42.

The stationary arcing contact 52 is covered with an arc-resisting layer 59 made of arc-resisting metal from the outer end thereof to a predetermined position thereon. This position is determined in such a manner as to achieve the following.

Figure 9:
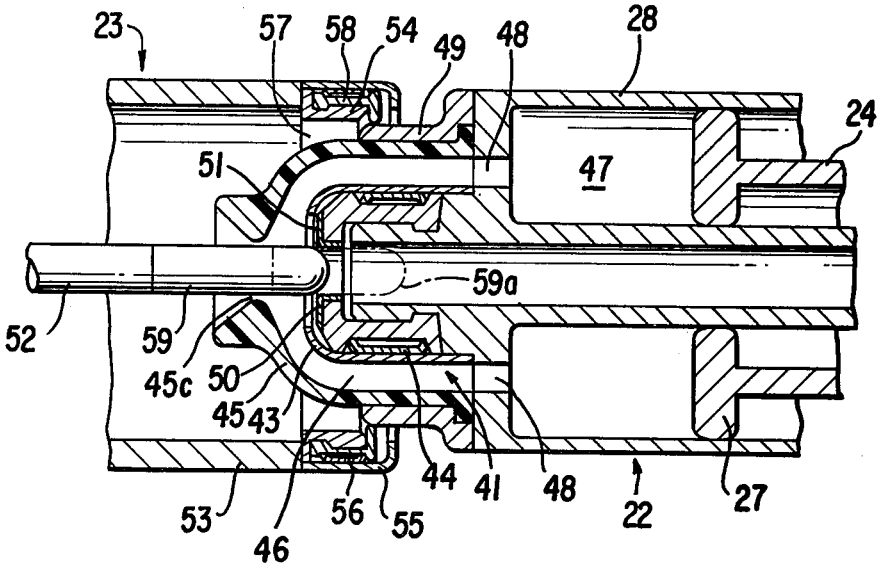
FIG. 9 is a longitudinal sectional view of the main part of a puffer type gas circuit breaker according to the embodiment of FIG. 3, in which the condition where a movable arcing contact is engaged with a stationary arcing contact to the deepest extent and the condition where the movable arcing contact has just been disengaged from the stationary arcing contact are illustrated.

When the movable arcing contact 41 is engaged with the stationary arcing contact 52 to the deepest extent, the arc-resisting layer 59 is in electric contact with the arc-resisting portion 51. In FIG. 9, the arc-resisting layer in this state is illustrated by an imaginary line and reference numeral 59*a* is attached to the arc-resisting layer. When the movable arcing contact 41 is disengaged from the stationary arcing contact 52 and when the arc-resisting portion 51 of the movable arcing contact 41 is separated from the end of the stationary arcing contact 52, the left end (as viewed from FIG. 9) of the arc-resisting layer 59 is located on the left side (as viewed from FIG. 9) of the ring-shaped gap 45*c* defined by the nozzle 45. The arc-resisting layer 59 in this state is illustrated by a solid line in FIG. 9.

Since the length of the arc-resisting layer 59 is determined as above, the electric contact between the movable arcing contact 41 and the stationary arcing contact 52 is always performed between the arc-resisting layer 59 and the arc-resisting portion 51. When the breaker cuts off currents, arcs are generated between the arc-resisting layer 59 and the arc-resisting portion 51. Therefore, the arcing contacts 41, 52 are little affected by the arcs.

Parts 22, 26, 34, 42, 49, 52, 53, 54, 58 are made of a good conductor such as aluminum, copper or iron.

The arcing contacts 41, 52 are chosen to have higher contact resistance than the main contacts 49, 57.

In operation, where a puffer type gas circuit breaker according to one embodiment of this invention is closed as shown in FIG. 3, large current chiefly flows through the main contacts 49, 57. Now let it be assumed that a short circuit current runs, and the drive mechanism 30 (FIG. 2) is actuated to retract the movable puffer cylinder 28. Then, the main movable contact 49 is first disengaged from the main stationary contact 57. Since, at this time, the arcing contacts 41, 52 contact each other, current is transferred through the arcing contacts 41, 52. Therefore, no arcs are generated between the main contacts 49, 57. As described above, during the operation, no arc is generated and the arc-extinguishing gas within the cylinder chamber 47 is expelled through the hole 48, passage 46 and ring-shaped gap 45*c* to the space 45*b* outside the nozzle 45 when the puffer cylinder 28 and the movable arcing contact 41 simultaneously begin to operate.

Where the movable puffer cylinder 28 further recedes and the movable arcing contact 41 is removed from the stationary arcing contact 52, an arc of large current is produced, as shown in FIG. 4, in the form marked with the numeral 60 between the movable and stationary arcing contacts 41, 52. Since, however, the movable puffer cylinder 28 is retracted, the arc-extinguishing gas compressed by the stationary puffer piston 27 in the cylinder chamber 47 is expelled to the space 45*b* outside the nozzle in the same manner and immediately after the gas mentioned above. While it is being expelled, the arc 60 is puffed and the current is completely cut off. As described above, the ring-shaped gap 45*c* inside the nozzle 45 is wide enough for the gas to pass through and the gap 45*c* is not clogged owing to the arcs generated between both contacts 52 and 41.

In operation, the arc-extinguishing gas flows through the passage defined by the front face of the movable arcing contact 41 and the internal face of the nozzle 45, i.e., the arc generation area before the arcs are generated. Therefore, the heat resulting from generation of the arc is carried to the outside of the nozzle 45 from an early stage of arc generation. The arcs are thus effectively extinguished, and the stationary arcing contact 52 and the movable arcing contact 41 are prevented from being damaged.

Since the arc-resisting portion 59 of the stationary arcing contact 52 extends within the range described above, arcs are generated between the arc-resisting portion 59 and the L-shaped contact element 50 of the arc-resisting material of the movable arcing contact 41. Therefore, the stationary arcing contact 52 and movable arcing contact 41 can withstand long use.

The embodiment of FIGS. 3 to 5 has the undermentioned advantages. The arc 60 is generated, as shown in FIG. 4, within an area defined between the arc-resisting portion 51 of the arcing contact 41 prepared from arc-resisting metal and the arc-resisting portion 59 of the arcing contact 52 prepared from arc-resisting metal. But the arc 60 is not produced in the base material of at least the arcing contacts 41. In other words, the arc 60 appears only on the front and inner faces of the arc-resisting portion 51 of the movable arcing contact 41 prepared from arc-resisting metal, and does not reach the contact fingers 42 themselves. Consequently, the base material of the contact fingers 42 is saved from arc damage, thus rendering restriking of arcs little likely to appear between the arcing contacts 41 and 52 when they are opened. Further, at least the arc-generating portion of the stationary arcing contact 52 is covered with arc-resisting metal. Therefore arcs little tend to be produced between the arcing contacts 41 and 52, and the stationary arcing contact and movable arcing contact are prevented from being damaged by arcs.

Figure 6:
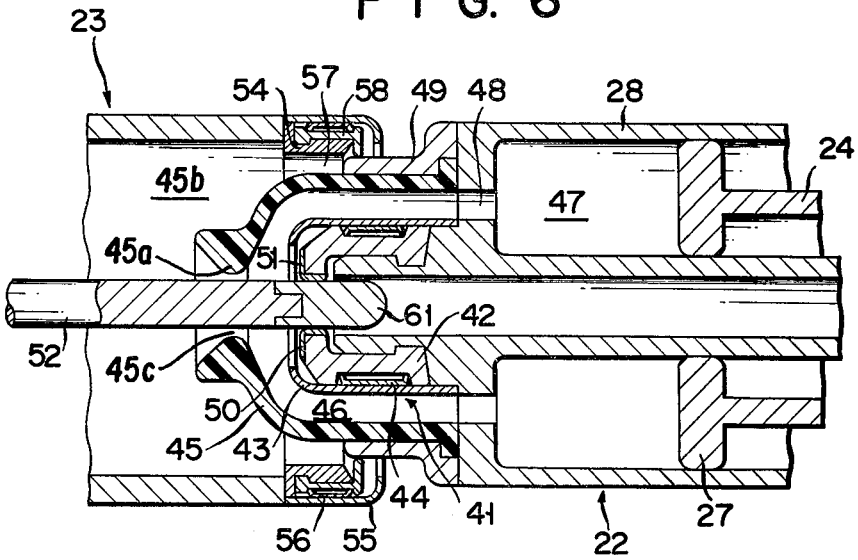
FIG. 6 is a longitudinal sectional view of the main part of a puffer type gas circuit breaker according to another embodiment of this invention when the main part is closed.
Figure 7:
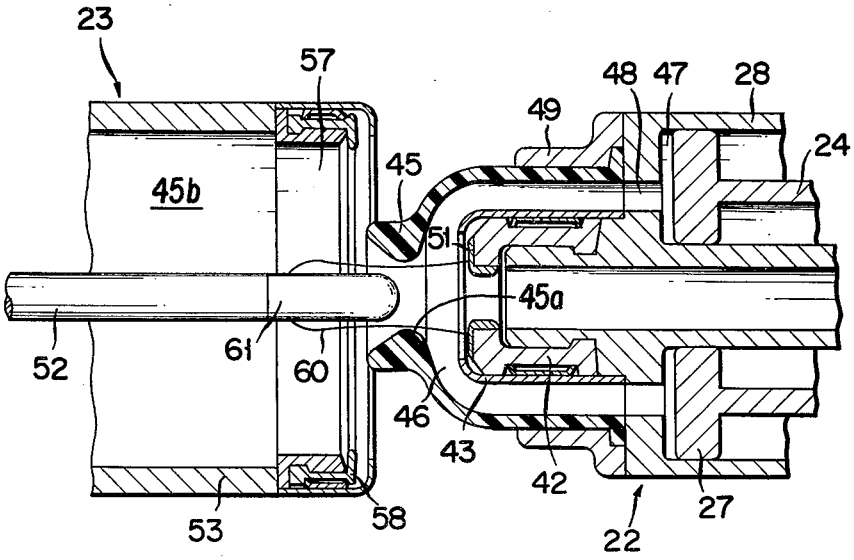
FIG. 7 is a longitudinal sectional view of the main part of a puffer type gas circuit breaker according to said another embodiment when the main part is opened.

The embodiment of FIGS. 6 and 7 has substantially the same construction and effect as that of FIGS. 3 to 5, except that an arc-resisting portion 61 is separately formed at the end of the stationary arcing contact 52. Therefore, the same parts of the embodiment of FIGS. 6 and 7 as these of the embodiment of FIGS. 3 to 5 are denoted by the same numerals, description thereof being omitted. FIG. 6 shows the closed state of the puffer type gas circuit breaker of this invention and FIG. 7 indicates the open state thereof.

Where a puffer type gas circuit breaker of any form and arrangement repeats the current-shutting operation, that portion of the surface of the arcing contacts which is exposed to arcs is progressively damaged by arcs, until a contactless condition appears between the arcing contacts, preventing current from being transferred from the main contacts to the arcing contacts, with the resultant generation of arcs between the main contacts. Since these arcs are not puffed out by an arc-extinguishing gas, there results the failure to shut off current.

Figure 8:
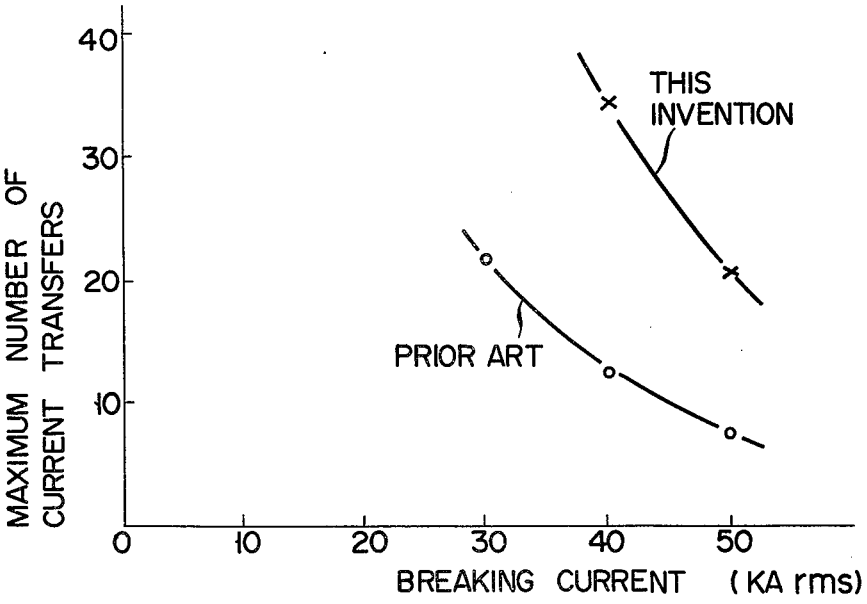
FIG. 8 is a graph showing current transfer characteristics of this invention and the prior art breaker.

FIG. 8 graphically shows a maximum number of transfers of breaking current occurring in the puffer type gas circuit breakers of the prior art and this invention will the arc period at the opening of the circuit breaker taken to be a length of time corresponding to one cycle. FIG. 8 proves that the contacts of a puffer type gas circuit breaker embodying this invention have an effective life 2.5 to 3 times longer than those of the prior art circuit breaker of the similar type.

What we claim is:

1. A puffer type gas circuit breaker comprising:

a housing having a first end and a second end;

a rod-shaped stationary arcing contact immovably set at said first end of the housing and extending axially therefrom toward said second end of the housing;

a stationary puffer piston immovably set at said second end of the housing, at a distance from the stationary arcing contact and in axial alignment with the stationary arcing contact, and extending therefrom toward said first end of the housing;

a movable puffer cylinder having at a first end a forward end wall with a hole therethrough and at a second end an opening, said stationary puffer piston being inserted through said opening, thus defining a cylinder chamber between said forward end wall and said stationary puffer piston;

arc extinguishing gas filled in the cylinder chamber;

means for reciprocating the movable puffer cylinder in the axial direction thereof;

a substantially ring-shaped movable arcing contact attached to said first end of the movable puffer cylinder in axial alingment with the movable puffer cylinder, said stationary arcing contact being inserted into the movable arcing contact and thus put into slidable and electrical contact therewith when the movable puffer cylinder is moved in one direction and being pulled out of the movable arcing contact and thus put out of slidable and electrical contact therewith when the movable puffer cylinder is moved in the other direction;

conductor means for supplying the stationary and movable arcing contacts with current to be interrupted;

a cup-shaped nozzle made of electrically insulative material, positioned at said first end of the movable puffer cylinder, surrounding said movable arcing contact and extending coaxially with the movable puffer cylinder, a passage being formed between said cup-shaped nozzle and the movable arcing contact, said cup-shaped nozzle having at one end a throat through which the stationary arcing contact extends, said throat having a diameter larger than that of the stationary arcing contact so that a ring-shaped gap is provided between the throat and the stationary arcing contact, and said cylinder chamber communicating with an area outside the cup-shaped nozzle through said ring-shaped gap, the passage between the cup-shaped nozzle and the movable arcing contact and the hole of said forward end wall;

a first arc resisting member made of arc resisting material, attached to that end face of the movable arcing contact which faces the throat of the cup-shaped nozzle and to that part of the inner periphery of the movable arcing contact which is continuous with said one end face;

a second arc resisting member made of arc resisting material and attached to the end of the stationary arcing contact extending toward said second end of the housing, said second arc resisting member extending to at least that portion of the stationary arcing contact which defines said ring-shaped gap with the throat of the cup-shaped nozzle, when the stationary arcing contact is moved relative to the movable arcing contact to a position where the stationary arcing contact leaves the movable arcing contact, the first arc resisting member and the second arc resisting member being in electric contact with each other even when the movable arcing contact is engaged with the stationary arcing contact to the deepest extent; and main contact means connected in parallel to both arcing contacts for opening the external circuit before opening both arcing contacts;

whereby as long as said stationary and movable arcing contacts are kept in mutual contact, both arc resisting members contact each other, and arc generated only between the first and second arc resisting member when both arcing contacts leave each other is extinguished by arc extinguishing gas supplied from said cylinder chamber and flowing along said stationary arcing contact, the arc extinguishing gas passed through the arc being exhausted through said gap supplied at the time just after the movable arcing contact leaves the stationary arcing contact.

2. A puffer type gas circuit breaker comprising:

a housing in which an arc-extinguishing gas is filled;

a rod-shaped stationary contact set in the housing;

a movable puffer cylinder used as a movable arcing contact and having a bore into which the stationary arcing contact is inserted;

said contacts being separable relatively from each other;

a puffer means for driving the arc-extinguishing gas simultaneously when the circuit breaker begins a breaking operation;

a first arc-resisting metal portion provided on the inner wall of the bore of the movable puffer cylinder;

a second arc-resisting metal portion provided on the stationary arcing contact with which the first arc-resisting metal portion slidably contacts;

said second arc-resisting metal portion extending from the projecting end of the stationary arcing contact to a position which is located outside the gap, as viewed immediately after the stationary arcing contact is relatively extracted from the bore of the movable puffer cylinder.

* * * * *